US006464451B1

(12) United States Patent
Conrad et al.

(10) Patent No.: US 6,464,451 B1
(45) Date of Patent: Oct. 15, 2002

(54) VACUUM PUMP

(75) Inventors: Armin Conrad, Herborn; Wolfgang Eberl, Solms, both of (DE)

(73) Assignee: Pfeiffer Vacuum GmbH, Asslar (DE)

( * ) Notice: Subject to any disclaimer, the term of this patent is extended or adjusted under 35 U.S.C. 154(b) by 28 days.

(21) Appl. No.: 09/655,981

(22) Filed: Sep. 6, 2000

(30) Foreign Application Priority Data

Sep. 6, 1999 (DE) ..... 199 42 410

(51) Int. Cl.[7] ..... F04D 5/00; F04D 19/04

(52) U.S. Cl. ..... 415/55.7; 415/55.5; 415/90; 415/143

(58) Field of Search ..... 415/90, 143, 55.1, 415/55.5, 55.6, 55.7; 417/423.4

(56) References Cited

U.S. PATENT DOCUMENTS 3,628,894 A * 12/1971 Ferguson, Jr. et al. ..... 415/90
3,666,374 A * 5/1972 Becker ..... 415/90
4,904,155 A * 2/1990 Nagaoka et al. ..... 415/90
5,074,747 A * 12/1991 Ikegami et al. ..... 415/90
5,611,660 A * 3/1997 Wong et al. ..... 415/90
5,709,528 A * 1/1998 Hablanian ..... 415/90

FOREIGN PATENT DOCUMENTS

DE 2354046 A1 * 5/1975 ..... 415/90
SU 294958 A * 3/1971 ..... 415/143

* cited by examiner

*Primary Examiner*—Christopher Verdier
(74) *Attorney, Agent, or Firm*—Sidley Austin Brown & Wood, LLP

(57) ABSTRACT

A vacuum pump, including a housing having inlet and outlet; a shaft arranged in the housing and supported bearing provided in the housing, drive for rotating the shaft; and a plurality of pumping units arranged in the housing and formed each of rotational and stationary gas delivery components with the rotational components being supported on the shaft and the stationary components being connected with the housing, at least one of the pumping units consisting of a plurality of connected parallel to each other and arranged one after another in an axial direction, molecular pumping stages with each pumping stage being formed based on Gaede principle; with the molecular pumping stages being connected with each other in common connection channels.

4 Claims, 1 Drawing Sheet

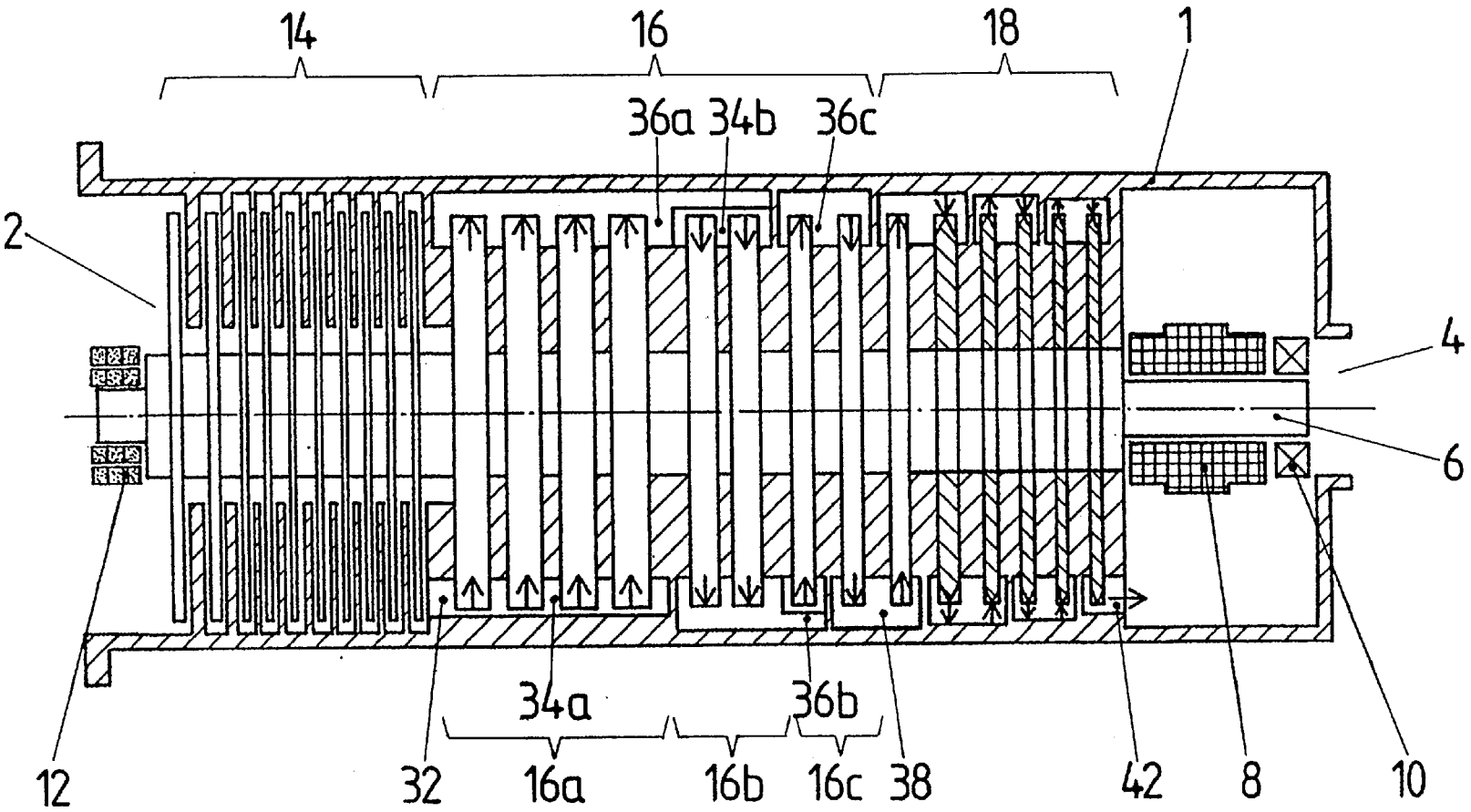
4
6
10
8
1
42
18
38
36c
36b
16c
34b
16b
36a
16
34a
16a
32
14
2
12

VACUUM PUMP

BACKGROUND OF THE INVENTION

1. Field of the Invention

The present invention relates to a vacuum pump for generating high vacuum and including a housing having a gas inlet opening and a gas outlet opening, a shaft arranged in the housing, bearing means provided in the housing for supporting the shaft, drive means for rotating the shaft, and a plurality of pumping units arranged in the housing and formed each of rotational and stationary gas delivery components, with rotational components being supported on the shaft and the stationary components being connected with the housing.

2. Description of the Prior Art

For obtaining a high vacuum, combinations of different types of vacuum pumps are necessary. This is because a wide pressure range between the atmospheric pressure and the high vacuum pressure encompasses several flow regions in which the physical characteristics of conditions and flow regions of gases are subjected to different laws of physics.

Thus, for obtaining a high vacuum, at least two vacuum pumps of different types and with different operational characteristics are required, which are connected so that a single pump stand is formed. Known are pump stands formed of a turbomolecular pump, which is used as a high vacuum pump, and a vane rotary pump dischargeable in atmosphere. Pump stands formed of at least two vacuum pumps necessary for obtaining the required vacuum-technical values such as pressure ratio and suction or pumping speed, have serious drawbacks. These pump stands are expensive and require a large floor space. Each pump requires its own drive system with necessary current supply, monitoring and control, and requires its own bearing system.

For generating or obtaining high or ultra high vacuum, turbomolecular pumps found a wide application. However, the field of their use is limited by the achievable high pressure. Because of their operational characteristics, they can operate effectively only at pressures up to about $10^{-3}$ mbar.

In the transitional pressure region between the high pressure and the atmospheric pressure, in multi-stage systems, regenerative pumps can be used. They can easily be combined with turbomolecular pumps and other molecular pumps. The rotor elements of both pumps, e.g., of a turbomolecular pump and regenerative pump can be mounted on a common shaft, forming a unitary assembly.

However, the transition from a turbomolecular pump stage or another molecular pump stage and a regenerative pump stage cannot be carried out smoothly. The compression of the turbomolecular pump stage decreases with increase in pressure, and a compression of a regenerative pump stage decreases at a lower pressure. Thus, the operational regions of both pump stages practically do not intersect.

The lack of compression in the transitional region between the molecular pump stage and the regenerative pump stage can be made up with Gaede stages. However, the Gaede stage has a very low suction or pumping speed in comparison with a turbomolecular pump stage. Therefore, only a small portion of the gas volume delivered from the last stage of the turbomolecular pump can be delivered further. Thus, the total suction or pumping speed of the pump combination is substantially reduced.

Accordingly, an object of the present invention is to .provide a vacuum pump encompassing the entire pressure region from the atmospheric pressure up to the high and ultra high vacuum region.

Another object of the present invention is to provide a vacuum pump encompassing the above-mentioned pressure region, formed as a unitary assembly, and having a compact structure, and in which the drawbacks, which characterize pump stands formed of several pumps, are eliminated.

A further object of the present invention is to provide a vacuum pump, as described above, and having satisfactory pressure ratios and suction speeds capable of meeting the requirements of practical applications of such pumps. The vacuum pump should be reliable in operation.

SUMMARY OF THE INVENTION

These and other objects of the present invention, which will become apparent hereinafter, are achieved by providing a vacuum pump having a plurality of pumping units arranged in the housing and formed each of rotational and stationary gas delivery components, with the rotational components being supported on the shaft and the stationary components being connected with the housing, with at least one of the pumping units being form of a plurality of connected parallel to each other and arranged one after another in an axial direction, molecular pumping stages each formed based on Gaede principle, and with common connection channels for connecting the molecular pumping stages with each other in such a way that a parallel delivery of a compressed gas takes place.

The parallel connection of the Gaede pump stages according to the present invention permits to obtain a compact vacuum pump covering the entire pressure region from the atmospheric pressure to the high and ultrahigh vacuum. The combination of small pumping units, which is obtained by the use of Gaede pump stages connected in parallel and seriesly, permits to achieve optimal pump characteristics and an effective operation. The suction speed at the suction opening can be optimally used over the entire pressure region as the pressure consistency can be so established that the gas amount is delivered from a preceding pumping unit or pump stage to a following pumping unit or stage without any losses. The advantages of the present invention are particularly achieved when the parallel Gaede stages are combined with a turbomolecular pump or with a regenerative pump, or with both pumps.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWING

Single FIGURE shows a cross-sectional view of a vacuum pump according to the present invention.

DETAILED DESCRIPTION OF THE PREFERRED EMBODIMENT

In the vacuum pump according to the present invention, which is shown in the drawing, three pumping units are arranged in the pump housing 1 having a gas inlet opening 2 and a gas outlet opening 4. The pumping units consist each of rotatable and stationary gas delivery components. The rotatable components are arranged on a shaft 6 one after another in an axial direction. The shaft 6 is supported in opposite bearings 10 and 12 and is driven by a drive 8. The stationary components are connected with the housing 1.

The pumping unit 14, adjacent to the gas inlet opening 2, is formed as a turbomolecular pump. The pumping unit 16, which is arranged downstream of the pumping unit 14 in a gas flow direction, consists of several sub-units 16*a*, 16*b* and 16*c*. Each sub-unit 16*a*, 16*b*, 16*c* includes one or more molecular pumping stages based on a Gaede principle and which will be referred below as Gaede stages. Inside the sub-units 16*a*, 16*b* and 16*c*, the Gaede stages are arranged parallel to each other. This means that connection elements 34*a* for the sub-unit 16*a* or 34*b* for the sub-unit 16*b* so connect the inlet sides and, on the other side, the outlet sides of the Gaede stages that a parallel gas flow in each sub-unit 16*a*, 16*b* takes place. In the embodiment shown in the drawings, the sub-unit 16*a* consists of four parallel Gaede stages, the sub-unit 16*b* consists of two parallel Gaede stages, and the sub-unit 16*c* consists of two separate, seriesly connected Gaede stages. The connection elements 36*a*, 36*b* and 36*c* so connect the Sub-units 16*a* 16*b* 16*c* that an outlet side of one sub-unit is connected with the inlet side of another sub-unit. The gas outlet opening of an adjacent pumping unit is formed as a multi-stage regenerative pump.

The pumping units 14 and 16 are connected by a connection channel 32 and the pumping units 16 and 18 are connected by a connection channel 38 in the same manner as the sub-units 16*a*, 16*b* and 16*c*. The pumping unit 18 is connected with the gas outlet opening 4 by a conduit 42.

The gas, which is aspirated at the high vacuum side through the gas inlet opening 2, is compressed by the turbo-molecular pumping unit 14 and is delivered further via the connection conduits 32 to the second pumping unit 16. The first sub-unit 16*a* delivers the gas further. Because the sub-unit 16*a* includes several Gaede stages four connected parallel with each other, the entire amount of the gas, which was compressed by the turbomolecular pump, can be delivered further. In the sub-unit 16*a*, the gas is further compressed. That is why it is sufficient for the next sub-unit 16*b* to contain only two Gaede stages for further compressing the gas, and for the sub-unit 16*c* to contain only one Gaede stage. The regenerative pump located downstream of the last Gaede stage compresses the gas, without any losses, to a high pressure and delivers it further.

In accordance with the application field and in accordance with the particular vacuum technical requirements, the combination of pumping units can be varied. Thus, for a particular application, a combination of a turbomolecular pump with only the pumping unit 16 may suffice. For another application, a combination of Gaede stages and a regenerative pump can meet the necessary requirements.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments with the spirit and scope of the present invention as defined by the appended claims.

What is claimed:

1. A vacuum pump, comprising a housing having a gas inlet opening and a gas outlet opening; a shaft arranged in the housing; bearing means provided in the housing for supporting the shaft; drive means for rotating the shaft; a plurality of pumping units arranged in the housing and formed each of rotational and stationary gas delivery components with the rotational components being supported on the shaft and the stationary components being connected with the housing, at least one of the pumping units comprising a plurality of connected parallel to each other and arranged one after another in an axial direction, molecular pumping stages with each pumping stage being formed based on the Gaede principle; and common connection channels for connecting the molecular pumping stages with each other in such a way that a parallel delivery of a compressed gas takes place.

2. A vacuum pump as set forth in claim 1, wherein each of the plurality of pumping units comprises at least one pumping stage formed based on the Gaede principle, and wherein the pumping units are arranged one behind another, with the pumping stages extending parallel to each other.

3. A vacuum pump as set forth in claim 1 wherein the pumping unit adjacent to the gas inlet opening is formed as a turbomolecular pump.

4. A vacuum pump as set forth in claim 1, wherein the pumping unit adjacent to the gas outlet opening is formed as a regenerative pump.

* * * * *